US008272122B2

(12) United States Patent
Panthofer et al.

(10) Patent No.: US 8,272,122 B2
(45) Date of Patent: Sep. 25, 2012

(54) TUBE MILL WITH IN-LINE BRAZE COATING PROCESS

(75) Inventors: William E. Panthofer, Jackson, TN (US); Yoram Leon Shabtay, Prospect Heights, IL (US)

(73) Assignee: Mill Masters, Inc., Jackson, TN (US)

( * ) Notice: Subject to any disclaimer, the term of this patent is extended or adjusted under 35 U.S.C. 154(b) by 1175 days.

(21) Appl. No.: 11/859,895

(22) Filed: Sep. 24, 2007

(65) Prior Publication Data

US 2008/0034571 A1 Feb. 14, 2008

Related U.S. Application Data

(63) Continuation-in-part of application No. 11/160,118, filed on Jun. 9, 2005, now abandoned.

(60) Provisional application No. 60/521,643, filed on Jun. 9, 2004, provisional application No. 60/522,287, filed on Sep. 13, 2004.

(51) Int. Cl.
*B23P 19/00* (2006.01)

(52) U.S. Cl. ..... 29/819; 29/890.032; 29/430

(58) Field of Classification Search ..... 29/890.046–890.049, 890.032, 29/890.038, 429–430, 458–460, 525.14, 29/525.15, 819, DIG. 4, DIG. 39
See application file for complete search history.

(56) References Cited

U.S. PATENT DOCUMENTS

| | | | | |
|---|---|---|---|---|
| 4,318,289 | A * | 3/1982 | Eaton | 72/131 |
| 4,681,772 | A * | 7/1987 | Rairden, III | 427/448 |
| 5,044,293 | A * | 9/1991 | Andoe | 114/88 |
| 5,217,746 | A * | 6/1993 | Lenling et al. | 427/450 |
| 5,482,744 | A * | 1/1996 | Pearson | 427/455 |
| 5,656,332 | A * | 8/1997 | Saito et al. | 427/178 |
| 5,733,662 | A * | 3/1998 | Bogachek | 427/446 |
| 5,784,776 | A * | 7/1998 | Saito et al. | 29/890.046 |
| 5,868,299 | A * | 2/1999 | Abbey, III | 228/147 |
| 6,042,659 | A * | 3/2000 | Brown et al. | 148/519 |
| 6,198,068 | B1 * | 3/2001 | Lindstrom | 219/121.46 |
| 6,319,615 | B1 * | 11/2001 | Jansen | 428/469 |
| 6,530,514 | B2 * | 3/2003 | Shabtay | 228/183 |
| 6,997,371 | B2 * | 2/2006 | Shabtay | 228/183 |
| 7,000,823 | B2 * | 2/2006 | Dockus et al. | 228/262.51 |
| 7,032,808 | B2 * | 4/2006 | Shabtay | 228/183 |
| 2001/0037559 | A1 * | 11/2001 | Prater et al. | 29/726 |
| 2002/0100793 | A1 * | 8/2002 | Fried | 228/119 |
| 2003/0155409 | A1 * | 8/2003 | Dockus et al. | 228/245 |
| 2003/0161966 | A1 * | 8/2003 | Bible et al. | 427/496 |

(Continued)

*Primary Examiner* — David Bryant
*Assistant Examiner* — Christopher Koehler
(74) *Attorney, Agent, or Firm* — Hartman Global IP Law; Gary M. Hartman; Domenica N. S. Hartman

(57) ABSTRACT

A tube mill apparatus and process for continuously forming and coating a tube with a braze alloy. The apparatus and process produce a continuously moving welded tube by continuously forming and welding a tubing material, after which the welded tube is passed through a sizing station to establish a desired outer shape and desired outer dimensions for the welded tube. The braze alloy is then deposited on a roughened surface of the welded tube that is clean and free of oils and coolants. The braze alloy is deposited with a wire arc spray gun that heats a wire of a metallic material and causes the heated metallic material to travel in a direction transverse to the direction of tube travel and deposit on the roughened surface of the tube to form an adherent layer of the braze alloy. Finally, any bow in the welded tube is removed as the tube travels away from the spray gun.

20 Claims, 2 Drawing Sheets

U.S. PATENT DOCUMENTS

2004/0035910 A1* 2/2004 Dockus et al. ..... 228/56.3
2004/0035911 A1* 2/2004 Dockus et al. ..... 228/56.3
2004/0038070 A1* 2/2004 Dockus et al. ..... 428/652
2005/0184132 A1* 8/2005 Shabtay ..... 228/183
2006/0054184 A1* 3/2006 Mozetic et al. ..... 134/1.1

* cited by examiner

TUBE MILL WITH IN-LINE BRAZE COATING PROCESS

CROSS REFERENCE TO RELATED APPLICATIONS

This is a continuation-in-part patent application of co-pending U.S. patent application Ser. No. 11/160,118, filed Jun. 9, 2005, which claims the benefit of U.S. Provisional Application No. 60/521,643 filed Jun. 9, 2004, and 60/522,287 filed Sep. 13, 2004.

BACKGROUND OF THE INVENTION

The present invention generally relates to equipment and processes for producing tubes, and more particularly to a tube mill and process capable of in-line deposition of a braze coating on a tube, including tubes suitable for use in the manufacture of heat exchangers.

The manufacture of heat exchangers requires the joining of fluid passages (typically metal tubes) to heat transfer surfaces such as fins. For example, one type of heat exchanger construction used in the automotive industry comprises a number of parallel tubes that are joined to and between a pair of manifolds, creating a parallel flow arrangement. The ends of the tubes are typically metallurgically joined (brazed, soldered, or welded) to tube ports, generally in the form of holes or slots formed in a wall of each manifold. The tubes thermally communicate with high surface area fins in order to maximize the amount of surface area available for transferring heat between the environment and a fluid flowing through the tubes. The fins are typically in the form of flat panels having apertures through which tubes are inserted, or in the form of sinusoidal centers that are positioned between adjacent pairs of "flat" oval tubes with oblong cross-sections.

Tube-to-fin joints formed by brazing techniques are characterized by strong metallurgical bonds that can be formed at temperatures that do not exceed the softening temperatures of the components being joined, such as copper and aluminum tubes and fins widely used in automotive heat exchangers. One such brazing process is the CUPROBRAZE® process, which involves depositing a braze paste on the tubes or fins, which are then assembled and heated to a suitable brazing temperature. The paste used in the CUPROBRAZE® process contains binders and a metal braze alloy based on the CuSn-NiP system, for example, about 75% copper, about 15% tin, about 5% nickel, and about 5% phosphorus. Equipment for the CUPROBRAZE® process is commercially available from various sources, such as Schöler Spezialmaschinenbau GmbH and Bondmet, Ltd., and can be an offline standalone machine or integrated into a tube mill to provide a process that continuously forms and coats tubing suitable for heat exchanger applications.

Shortcomings of brazing operations that use a braze paste include relatively high material costs, labor requirements, and inconsistent coating thickness. Therefore, alternative processes would be desirable.

BRIEF SUMMARY OF THE INVENTION

The present invention provides a tube mill process and apparatus suitable for continuously forming and directly coating a tube with a braze alloy, without the use of a braze paste.

The apparatus includes means for producing a continuously moving welded tube by continuously forming and welding a tubing material, means for depositing the braze alloy on a surface of the welded tube, a sizing station to establish a desired outer shape and desired outer dimensions for the welded tube before deposition of the braze alloy, means for removing a bow in the welded tube following deposition of the braze alloy as the welded tube travels away from the depositing means. The depositing means includes at least one wire arc spray gun and at least one wire of a metallic material. The wire arc spray gun is operable to heat the metallic material and cause the metallic material to travel in a direction transverse to the direction that the welded tube is traveling and then deposit on the surface of the welded tube to form an adherent layer of the braze alloy.

The process of this invention involves operating a tube mill to produce a continuously moving welded tube by continuously forming and welding a tubing material, and then passing the welded tube through a sizing station to establish a desired outer shape and desired outer dimensions for the welded tube. The braze alloy is then deposited on a roughened surface of the welded tube that is clean and free of oils and coolants, after which any bow in the welded tube is removed. The braze alloy is deposited with at least one wire arc spray gun that heats a wire of a metallic material. The metallic material travels in a direction transverse to the direction the welded tube travels and deposits on the roughened surface of the welded tube to form an adherent layer of the braze alloy.

The apparatus and process of this invention provide for in-line forming and braze alloy coating of a tube whose diameter can be consistently produced for assembly with a manifold of a heat exchanger. The thermal spray process produces a braze alloy layer that is strong, clean, and dense without damaging or causing metallurgical changes within the tube, while any distortion of the tube caused by the thermal spray process is removed in-line with a bow control unit. The apparatus performs a sizing operation prior to coating deposition, and is therefore capable of producing an uncoated tube without requiring any adjustment or replacement of rolls used to form and size the tube.

Compared to prior deposition processes that deposit a braze paste, the apparatus and process of this invention are capable of directly forming on the tube surface a thin, uniform, and dense braze alloy layer immediately after the tube is formed on a tube mill and at typical tube mill speeds so that a continuous tube is coated and sized correctly as it leaves the tube mill. In further contrast to processes employing a braze paste, a secondary operation to dry the braze alloy layer is not required, and material costs are significantly reduced since the metallic material and the directly-deposited braze alloy layer do not require any binders.

Other objects and advantages of this invention will be better appreciated from the following detailed description.

DETAILED DESCRIPTION OF THE INVENTION

Figure 1:
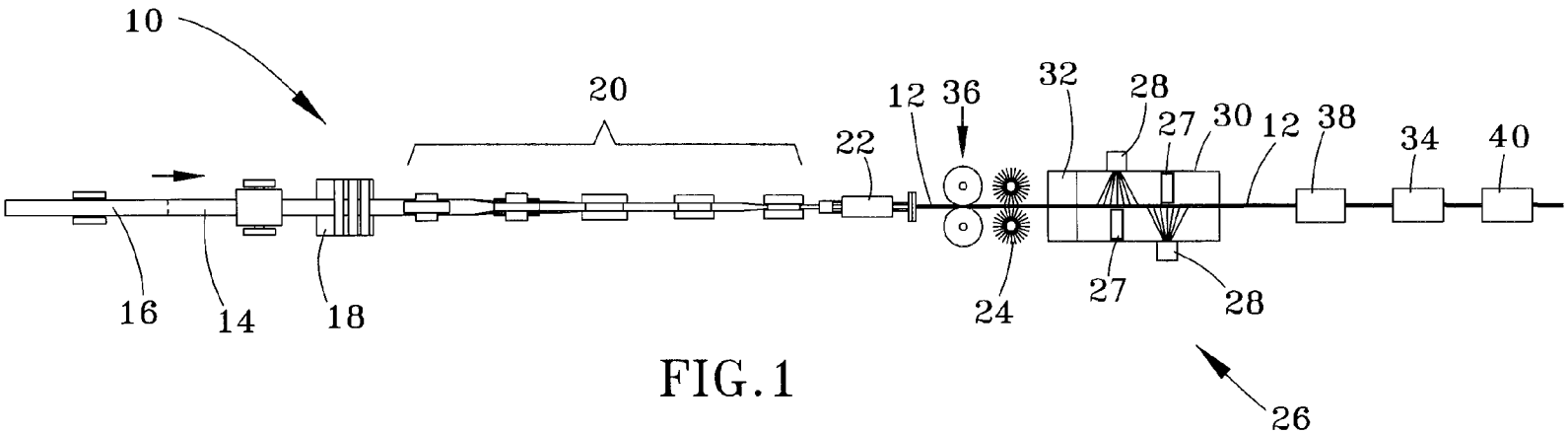
FIGS. 1 and 2 schematically represent plan and elevation views of a tube mill in accordance with a preferred embodiment of this invention.
Figure 2:
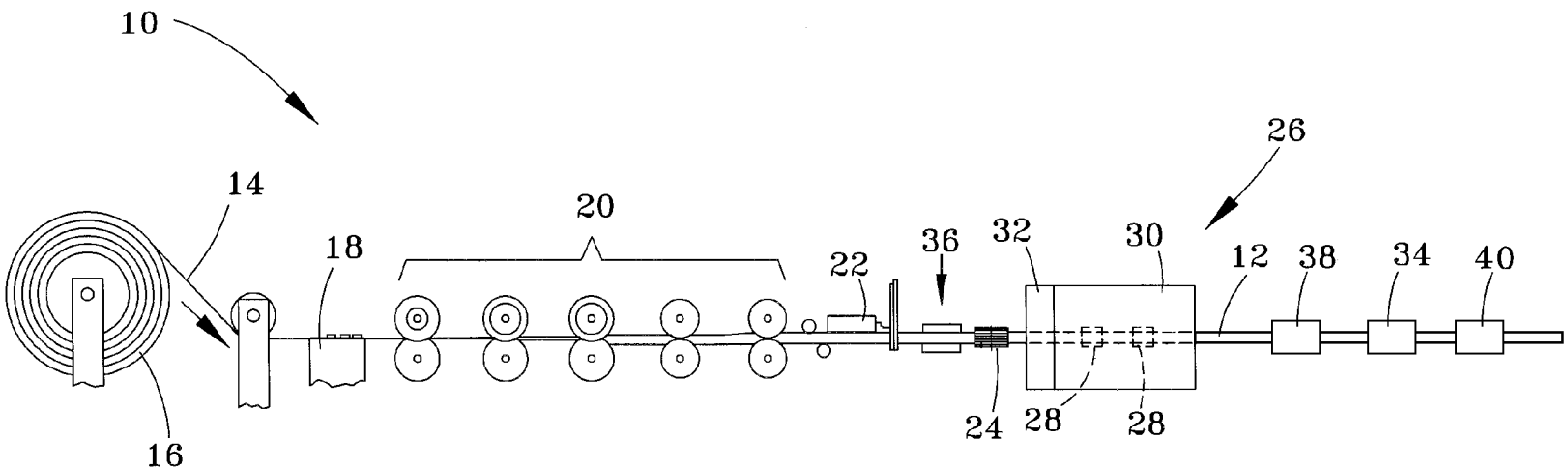

Illustrated in FIGS. 1 and 2 is a tube mill apparatus 10 in accordance with a preferred embodiment of the invention. The apparatus 10 performs an in-line spray process that applies a braze alloy coating directly on a continuously moving tube 12, such as a heat exchanger tube. While various cross-sectional shapes are possible, the tube 12 is preferably in the form of a "flat" oval tube with an oblong cross-section defined by two relatively wide oppositely-disposed flat surfaces. Such tubes, which typically range in width from about 10 mm to about 100 mm wide, are typically manufactured on tube mills at high linear velocities, such as 150 meters per minute. With the tube mill apparatus 10 of this invention, which incorporates thermal spray equipment to deposit a molten braze alloy onto the tube 12 immediately after the tube 12 is formed, a preferred maximum linear velocity is believed to be about 150 meters per minute. The tube 12 is formed from suitable metal stock, such as a strip 14 of copper alloy for the production of a copper alloy tube 12. Because the forming and coating processes are continuous, the strip 14 is continuously fed from a large spool 16 in accordance with conventional tube mill processes.

Preferred braze alloys for forming the coating on a copper alloy tube 12 contain copper, tin, nickel, and phosphorus, though it is foreseeable that other coating materials could be used on copper alloy tubes 12 as well as on tubes 12 formed of other alloys. In practice, it has been determined that the coating must contain at least one weight percent nickel for field corrosion resistance and sufficient phosphorus as a flux during a subsequent brazing operation, for example, to remove oxides during brazing of a copper tube 12 to copper fins to form a heat exchanger. Preferred compositions for the braze alloy depend on the form in which the alloy is provided for deposition, which in turn depends on the thermal spray process used as discussed in greater detail below. In a preferred embodiment, the braze alloy is in wire form and preferably contains, by weight, about 6% to about 7% tin, about 1% to about 2.5% nickel, and about 6% to about 7% phosphorus, with the balance being copper and incidental impurities. If used in powder form, the braze alloy preferably contains, by weight, about 9.0% to about 15.6% tin, about 4.2% to about 5.4% nickel, about 5.3% to about 6.2% phosphorus, about 74.9% to about 79.4% copper, and incidental impurities. In practice, a minimum coating thickness of about 0.0007 inch (about 18 micrometers) is believed necessary to obtain an acceptable tube-to-fin braze. On a coverage basis, braze alloys of this invention are preferably deposited at a rate of about 100 to about 150 grams/$m^2$ on the tube 12 to obtain a good braze, though lesser and greater deposition rates are foreseeable.

FIGS. 1 and 2 depict the tube 12 as undergoing various tube mill operations before deposition of the braze alloy coating. As shown in FIGS. 1 and 2, the strip 14 passes through a strip guide 18 before passing through a series of paired opposing rolls 20 that deform the strip 14 into a tubular shape, after which the tubular-shaped strip 14 passes through a welding station 22 where the strip 14 is welded to yield the tube 12. The tube 12 may be welded in the shape (WIS), which means the tube 12 has the desired cross-sectional shape (e.g., flat oval) at the moment it is welded, or may be welded in the round (WIR), which means the tube 12 is formed up in a near circular shape, welded, and later shaped to acquire the desired cross-sectional shape (e.g., flat oval). Each pair of rolls 20 is typically different from the other pairs of rolls 20 to achieve the incremental process by which the flat strip 14 is transformed into a tubular shape. The rolls 20 can be generally categorized as form rolls that impart the circular cross-sectional shape of the tubular shape, preweld rolls (or seam guide stand) that align the opposing longitudinal edges of the strip 14, and weld rolls that push the longitudinal edges together as the tubular shape passes through the welding station 22, where the edges are welded together. Though not a requirement of the present invention, the preweld rolls (or seam guide stand) and weld rolls may be enclosed in a welding enclosure that may be purged with argon or nitrogen to inhibit oxidation of the tube 12. To promote the adhesion of the braze alloy coating, the welding operation and its equipment preferably do not use liquid coolants that might remain on the surface of the tube 12 and interfere with adhesion of the coating. For this reason, the preweld rolls (or seam guide stand), weld rolls, and other components in close proximity to the welding operation are preferably internally cooled with a suitable fluid (liquid, gas, or mixtures thereof), and not externally cooled with a liquid.

The dimensional tolerances for the rolls 20 are particularly critical if the tube 12 is to be assembled in a heat exchanger, requiring that the tube 12 is consistently formed to have a shape and diameter that will assemble with tube ports formed in the manifolds of the heat exchanger. As such, conventional practice when producing uncoated welded tubing is to place a sizing station as one of the last stations of a tube mill prior to cutting individual tubes to length at a cutoff station. A typical sizing station contains at least four pairs of rolls, each precisely sized to progressively establish the desired outer shape and dimensions of the tube being produced.

To ensure proper sizing of the coated welded tube 12 produced by this invention, conventional wisdom would also be to place a sizing station after the coating has been deposited and immediately prior to cutoff. However, FIGS. 1 and 2 show a sizing station 36 located immediately downstream of the welding station 22 and upstream of a coating station 26 at which the thermal spray process of this invention is performed. Though the sizing station 36 is represented by a single pair of sizing rolls, any number of pairs could be employed, including four pairs as typically found in conventional tube mills. No further sizing of the tube 12 is required to be performed after the coating process, which necessitates that the spray process is carried out to continuously deposit a coating of consistent thickness so that sizing after the coating operation is unnecessary. Though such a requirement provides an additional challenge to the in-line coating process of this invention, several notable advantages arise from this sequence of operations. First, the tube mill apparatus 10 is capable of producing both coated and uncoated tube 12 without any change in the sizing rolls within the sizing station 36, which would otherwise be required to accommodate both an uncoated tube whose diameter is established by the rolls 20 ahead of the welding station 22, as well as larger diameters of coated tubes 12 resulting from the coating process. As such, the present invention avoids the requirement of stopping the tube mill apparatus 10 to shim the existing sizing rolls or install different sizing rolls, and also avoids the considerable amount of scrappage that typically occurs when fine tuning the apparatus 10 to obtain the desired tube size and shape. Another advantage is improved life of the sizing rolls if abrasive tube coatings are deposited. Finally, the additional distance between the welding station 22 and the coating station 26 allows additional time to clean and dry the tube 12, reducing if not eliminating the concern for any residual liquid coolant being carried over from the rolls 20 and welding station 22 into the coating station 26, wherein poor coating adhesion and staining and oxidation of the tube 12 can occur if residual coolant is present on the tube 12 during coating.

Immediately downstream of the sizing station 36, FIGS. 1 and 2 show the tube 12 passing between an opposed pair of abrasive wire brush wheels 24 that roughen the flat surfaces of the tube 12 for the purpose of promoting adhesion of the braze alloy coating, which is preferably deposited on the flat surfaces that are later brazed to the fins. As alternatives to the brush wheels 24, the tube surfaces can be roughened with a bead blast, or the tube strip 14 could be supplied with a pre-brushed finish. However, processes that use a fine grit are believed to be unacceptable, since any residual grit embedded in the surface of the tube 12 will interfere with adhesion of the braze alloy coating. Following welding and surface roughening, the tube 12 must be dry and free of oils and coolant prior to the spray coating operation.

FIGS. 1 and 2 represent thermal guns 28 as being mounted to an enclosure 30 for the thermal spray process. The enclosure 30 is preferably equipped with a preheater 32 capable of heating the tube 12 to at least 150° F. (about 65° C.), which according to the invention is believed to promote adhesion of the braze alloy coating at the high speed at which the tube 12 is traveling during the coating process. The enclosure 30 may be equipped with any suitable sound abatement and dust collection system.

As known in the art, thermal spray processes involve spraying molten or at least heat-softened material onto a substrate surface to form a coating. A thermal spray process particularly encompassed by this invention is arc spray (also known as wire arc spray). In conventional wire arc spray processes, two wires of the desired coating material are typically used as electrodes across which a high voltage discharge is maintained to melt the wires, and air is forced between the two wires to atomize and propel the molten wire material at the substrate being coated. To deposit a braze alloy coating with the preferred wire composition noted above, the bulk composition of the wires will typically be essentially the same as the desired braze alloy coating. For this purpose, the entire wire may have the composition of the desired coating, or the wire can be formed to have a hollow core formed of copper or tin and filled with a powder whose composition is the balance of the desired coating.

While various wire arc spray could possibly be used with the present invention, the Model BP400 Electric Arc Spray System, available from Praxair Surface Technologies, has been determined to be capable of use with the invention, whereas other types of wire arc spray systems have not, in particular, wire arc spray systems with motorized wire pull-type systems that require relatively large diameter wires. A suitable standoff distance between the tube 12 and the wire tips is about two to about three inches (about 5 to about 7.5 cm), with greater standoff distances causing oxidation of the deposited material to the detriment of its brazeability. A suitable pressure for the air employed to atomize and propel the molten wire material is about 20 to about 35 psi (about 1.4 to 2.4 bar). To minimize deflection of the tube 12 during the coating process, a fixed and rigid support 27 for the tube 12 is preferably located opposite each spray gun 28.

Using an arc spray process, it has been determined that a shroud or atmosphere of inert or nonreactive gas is not required to avoid oxidation of the braze alloy while it is molten during and immediately after deposition. Instead, clean, dry compressed air has been found to work well as the carrier gas and deposition atmosphere, without resulting in excessive oxidation that would interfere with the brazing operation. The brazeability of the deposited coating can be judged based on its color. A coating having a gray color is sufficiently oxide-free to permit subsequent brazing. While exhibiting good adhesion, a gold-colored coating is oxidized to the extent that it will not braze successfully. Brazeability of the deposited coating is also dependent on the coating thickness, which as noted before is preferably at least about 0.0007 inch (about 18 micrometers), and preferably deposited at a rate of about 100 to about 150 grams/$m^2$ on a coverage basis. Importantly, the deposition rate can be carefully controlled with the arc spray process so that the final diameter of the tube 12 following coating can be accurately controlled, thereby eliminating any need for a sizing operation following coating deposition.

Another known thermal spray process that has been determined to perform poorly at best with this invention is plasma spray (also known as plasma arc spray and nontransferred arc spray). In plasma spray processes, material in powder form (preferably with the powder composition noted above) is injected into a very high temperature plasma generated by a gas (typically argon, nitrogen, hydrogen, or helium) forced through a high voltage discharge between two electrodes, causing the gas to rapidly heat and accelerate to a high velocity that carries the molten powder to the substrate being coated. The hot material impacts the substrate surface and rapidly cools to form the coating. This process is sometimes referred to as a cold process (relative to the substrate material) since the substrate temperature can be kept low during processing, thus avoiding damage, metallurgical changes, and distortion to the substrate material. However, at linear speeds preferably employed by this invention (up to about 150 meters per minute), plasma spray processes have been thus far found incapable of depositing a sufficient amount of braze alloy for a brazing operation, and the deposited coating tends to be brittle and flake off. Another shortcoming of plasma spray processes is their use of nitrogen as the plasma gas and argon to start the actual arc, necessitating a controlled argon purge to start the plasma gun then switching to nitrogen. Also, wire arc spray processes can immediately start spraying the braze alloy, whereas plasma spray processes require a minute or two to warm up before spraying can commence.

Thermal spray guns are typically only about 50% to about 80% efficient, necessitating that spray rates must accordingly exceed the coating coverage desired for the tube 12. If the coating is deposited by wire arc spraying, the desired coating coverage is also affected by the diameter of the wires used, which can be limited by the capability of forming small wires of certain braze alloys. As such, when optimizing a wire arc spray process, those skilled in the art will take into consideration typical wire arc spray rates, wire diameters, amperage of the power supply, and capabilities of wire feeders. Multiple arc spray guns 28 will typically be needed in view of the typical high line speeds of production tube mills, as well as for large tube cross-sections. The guns 28 can be arranged in a straight line, W, or V-shaped pattern along the horizontal direction of travel of the tube 12 through the enclosure 30. The interior walls of the enclosure 30 are preferably coated with a non-stick surface treatment or are otherwise formed of a material that inhibits adhesion of the over-spray from the spray guns 28.

Figure 3:
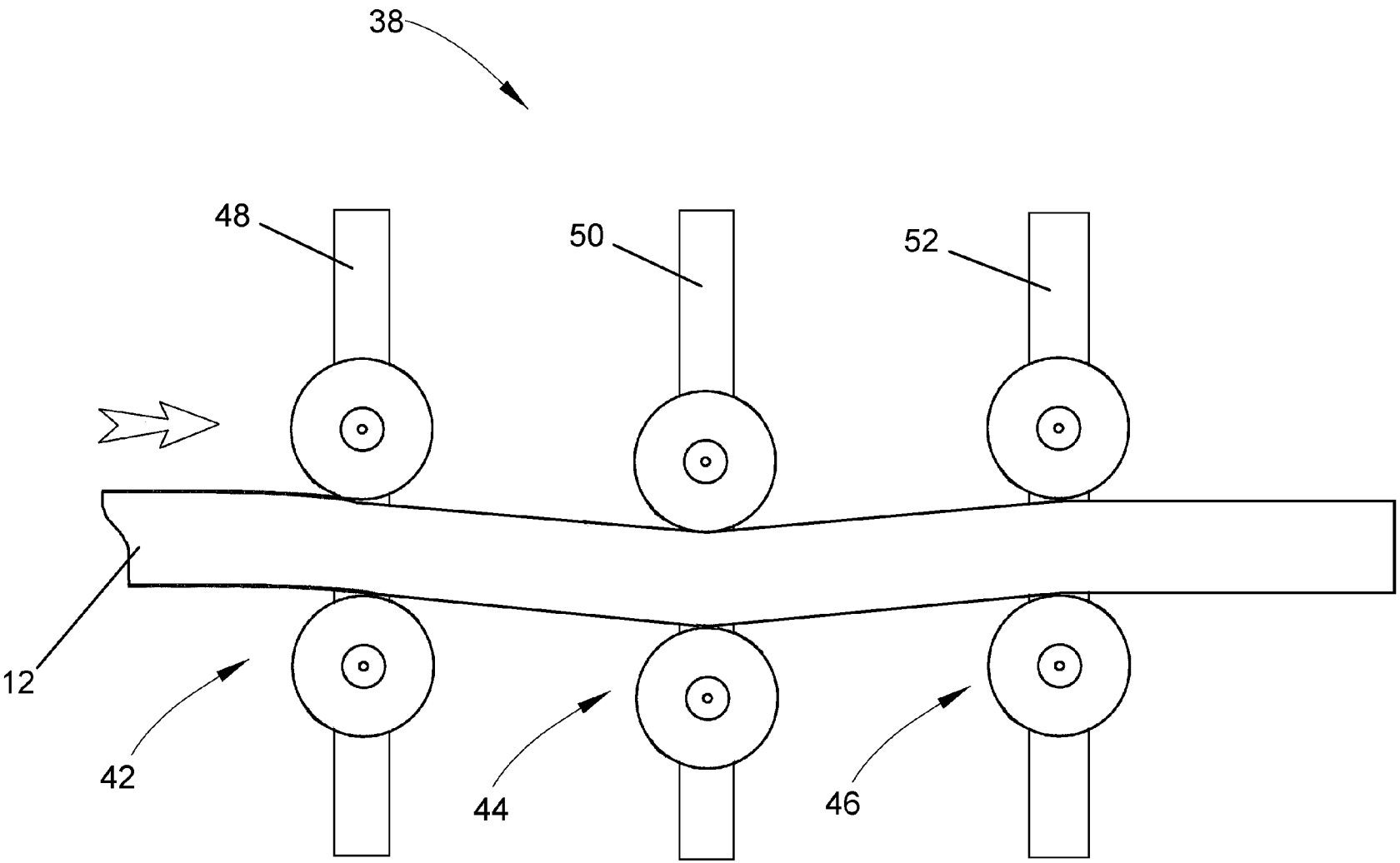
FIG. 3 schematically represents a plan view of a bow control station of the coating apparatus of FIGS. 1 and 2.

The deflection of the tube 12 is minimized during the coating process with the fixed support 27, bowing of the tube 12 nonetheless occurs, presumably due to the heat of the coating process and the braze coating surface tension. As such, FIGS. 1 and 2 show the tube mill apparatus 10 as including a bow control station 38 downstream of the coating station 26. The bow control station 38, represented in more detail in FIG. 3, contains a series of small rollers, preferably three opposing pairs 42, 44, and 46 as shown. The first and third pairs 42 and 46 are secured to rails 48 and 52 (or other suitable support structures) so that the positions are fixed relative to the tube 12. In contrast, the middle pair 44 of rollers are mounted on a rail 50 to permit movement of the roller pair 44 in directions transverse to the travel of the tube 12 and parallel to the directions at which the molten coating material traveled from the guns 28 during deposition on the tube 12. As shown exaggerated in FIG. 3, the middle pair 44 of rollers deflect the tube 12 in a direction opposite an existing bow induced during the coating operation, but only to the extent that the bow is removed once it leaves the station 38.

Finally, FIGS. 1 and 2 represent the apparatus 10 as including a cutoff station 40 downstream from the coating station 26, where the tube 12 is cut to length as known in the art. The apparatus 10 is also represented as having an optional quenching station 34, which may be located upstream of the cutoff station 40. If employed, the cooling operation is preferably carried out in a manner that cools the braze alloy coating on the tube 12 before the surface of the coating oxidizes. For this purpose, the quenching station 34 may be located immediately adjacent the coating station 26, or the tube 12 can be continuously enclosed and enveloped by an inert gas up to and through the quenching station 34.

While the invention has been described in terms of particular embodiments, it is apparent that other forms could be adopted by one skilled in the art. Therefore, the scope of the invention is to be limited only by the following claims.

The invention claimed is:

1. A tube mill for continuously forming a coated welded tube having at least one surface coated with a braze alloy, the tube mill comprising:

means for producing a continuously moving uncoated welded tube by continuously forming and welding a tubing material;

a sizing station operable to size the uncoated welded tube to form a sized uncoated welded tube having desired outer dimensions, the sizing station being located in the tube mill so as to size the uncoated welded tube before deposition of the braze alloy;

means for depositing the braze alloy on a surface of the sized uncoated welded tube, the depositing means comprising at least one wire arc spray gun and at least one wire of a metallic material, the wire arc spray gun being operable to heat the metallic material and cause the metallic material to travel in a direction transverse to a direction the sized uncoated welded tube is traveling and deposit on the surface of the sized uncoated welded tube to form the coated welded tube having an adherent layer of the braze alloy; and means for removing a bow in the coated welded tube following deposition of the braze alloy as the coated welded tube travels away from the depositing means;

wherein the tube mill does not have a sizing station located after the depositing means.

2. The tube mill according to claim 1, wherein the depositing means comprises at least two wire arc spray guns adapted to deposit layers of the braze alloy on the surface and on an oppositely-disposed surface of the sized uncoated welded tube.

3. The tube mill according to claim 1, wherein the sizing station is located immediately before the depositing means.

4. The tube mill according to claim 1, wherein the bow removing means is located immediately after the depositing means.

5. The tube mill according to claim 1, wherein the tubing material, the uncoated welded tube and the sized uncoated welded tube travel at a speed of up to about 150 meters per minute through the tube mill.

6. The tube mill according to claim 1, wherein the producing means produces the uncoated welded tube as welded in the shape (WIS) so that the uncoated welded tube, the sized uncoated welded tube, and the coated welded tube have the same cross-sectional shape.

7. The tube mill according to claim 1, wherein the depositing means comprises means for delivering clean dry air as a carrier gas for the metallic material.

8. The tube mill according to claim 1, further comprising means for roughening the surface of the tube upstream of the depositing means.

9. The tube mill according to claim 1, wherein the tubing material is formed with components within an enclosure in which the tubing material is welded, the components being internally cooled with a fluid and not externally cooled with a liquid.

10. The tube mill according to claim 1, wherein the bow removing means comprises at least first, second, and third pairs of opposing rollers that are encountered sequentially by the coated welded tube, wherein the second pair of the opposing rollers encountered by the coated welded tube is between and movable relative to the first and the third pairs of the opposing rollers encountered by the coated welded tube, the second pair of the opposing rollers being movable in directions transverse to the direction of travel of the coated welded tube and parallel to the direction that the metallic material traveled during deposition on the coated welded tube.

11. A tube mill process for continuously forming a coated welded tube having at least one surface coated with a braze alloy, the process comprising the steps of:

operating a tube mill to produce a continuously moving uncoated welded tube by continuously forming and welding a tubing material;

passing the uncoated welded tube through a sizing station to size the uncoated welded tube and form therefrom a sized uncoated welded tube having desired outer dimensions;

depositing the braze alloy on a roughened surface of the sized uncoated welded tube that is clean and free of oils and coolants, the braze alloy being deposited with at least one wire arc spray gun that heats a wire of a metallic material, the metallic material traveling in a direction transverse to a direction the sized uncoated welded tube is traveling and depositing on the roughened surface of the sized uncoated welded tube to form a coated welded tube having an adherent layer of the braze alloy; and then removing any bow in the coated welded tube as the coated welded tube travels away from the wire arc spray gun;

wherein the coated welded tube does not undergo sizing after the depositing step.

12. The tube mill process according to claim 11, wherein the depositing step employs at least two wire arc spray guns to deposit layers of the braze alloy on the roughened surface and on an oppositely-disposed roughened surface of the sized uncoated welded tube.

13. The tube mill process according to claim 11, wherein the braze alloy consists essentially of copper, tin, phosphorous, and at least 1 weight percent nickel.

14. The tube mill process according to claim 11, wherein the braze alloy consists essentially of, by weight, about 6% to about 7% tin, about 1% to about 2.5% nickel, and about 6% to about 7% phosphorus, with the balance being copper and incidental impurities.

15. The tube mill process according to claim 11, wherein the tubing material, the uncoated welded tube, and the sized uncoated welded tube travel at a speed of up to about 150 meters per minute.

16. The tube mill process according to claim 11, wherein the metallic material is deposited on the roughened surface at a rate of about 100 to about 150 grams/$m^2$.

17. The tube mill process according to claim 11, wherein the tubing material is continuously formed and welded to form the uncoated welded tube before the roughened surface is created on the sized uncoated welded tube.

18. The tube mill process according to claim 11, wherein the arc spray gun uses clean dry air as a carrier gas for the metallic material.

19. The tube mill process according to claim 11, wherein the tubing material is formed with components within an enclosure in which the tubing material is welded, the components being internally cooled with a fluid and not externally cooled with a liquid.

20. The tube mill process according to claim 11, wherein a bow is removed from the coated welded tube with at least first, second, and third pairs of opposing rollers that are encountered sequentially by the coated welded tube, wherein the second pair of the opposing rollers encountered by the coated welded tube is between and movable relative to the first and the third pairs of the opposing rollers encountered by the coated welded tube, the second pair of the opposing rollers being movable in directions transverse to the direction of travel of the coated welded tube and parallel to the direction that the metallic material traveled during deposition on the coated welded tube.

* * * * *